United States Patent [19]

Mannhart et al.

[11] Patent Number: 5,076,138

[45] Date of Patent: Dec. 31, 1991

[54] APPARATUS FOR INFEEDING CARTRIDGES TO AN ELEVATABLE FIRING WEAPON

[75] Inventors: Peter Mannhart, Eschenbach; Roland Streit, Opfikon; Kurt Müller, Zürich, all of Switzerland

[73] Assignee: Werkzeugmaschinenfabrik Oerlikon-Buhrle AG, Zurich, Switzerland

[21] Appl. No.: 532,655

[22] Filed: Jun. 4, 1990

[30] Foreign Application Priority Data

Jun. 30, 1989 [CH] Switzerland ..... 02446/89

[51] Int. Cl.[5] ..... F41A 9/30

[52] U.S. Cl. ..... 89/33.16; 89/34; 89/35.01

[58] Field of Search ..... 89/34, 35.01, 33.14, 89/33.16, 33.25, 33.2; 193/25 AC

[56] References Cited

U.S. PATENT DOCUMENTS

| | | | |
|---|---|---|---|
| 476,590 | 6/1892 | Archbold | 89/35.01 |
| 2,351,370 | 6/1944 | Schaaff | 193/25 AC |
| 2,568,229 | 9/1951 | Gardes | 193/25 AC |
| 2,809,562 | 10/1957 | Herlach | 89/33.25 |
| 2,890,779 | 6/1959 | Aumann | 193/25 AC |
| 2,905,056 | 9/1959 | Nectoux | 89/33.16 |
| 2,986,074 | 5/1961 | Dixon | 89/33.2 |
| 3,348,451 | 10/1967 | Vickers | 89/36.13 |
| 3,437,005 | 4/1969 | Trumper | 89/33.02 |
| 3,563,357 | 2/1971 | West | 193/25 AC |
| 4,437,384 | 3/1984 | Tassie | 89/37.02 |

FOREIGN PATENT DOCUMENTS

| | | | |
|---|---|---|---|
| 0152549 | 8/1985 | European Pat. Off. . | |
| 3204499 | 8/1983 | Fed. Rep. of Germany . | |
| 966693 | 10/1950 | France | 89/33.14 |
| 2436960 | 4/1980 | France . | |
| 343559 | 12/1936 | United Kingdom | 89/33.16 |
| 615830 | 2/1949 | United Kingdom . | |
| 2000576 | 1/1979 | United Kingdom . | |

OTHER PUBLICATIONS

English Translation of Tonnelier (Fr 966,693).

Material Handling New, No. 339, p. 49, Mar. 1986, "Bucket Conveyors Keep Coffee Free of Damage".

*Primary Examiner*—Deborah L. Kyle

*Assistant Examiner*—Stephen Johnson

*Attorney, Agent, or Firm*—Sandler, Greenblum, & Bernstein

[57] ABSTRACT

When cartridges are delivered from a stationary cartridge magazine to an elevatable firing weapon, it is customary to use a deflection or guidance unit, by which the cartridges can be reliably delivered to the elevatable firing weapon in every position of the latter. The cartridges are delivered to the elevatable firing weapon in a telescopic guide or infeed channel. With large elevation of the elevatable firing weapon, this telescopic guide channel is substantially contracted. On the other hand, this telescopic guide channel is substantially extended when the elevation of the elevatable firing weapon is relatively small. In the telescopic guide channel there is provided a bucket chain for conveying cartridges. The individual buckets of this bucket chain are interconnected by knee joints, so that the bucket chain can likewise be extended and contracted. One end of the telescopic guide channel is mounted at the stationary cartridge magazine and the other end is mounted at the elevatable firing weapon. The drive of the bucket chain is effected at both ends of the telescopic guide or infeed channel. Since the bucket chain is variable in length, this drive of the bucket chain need not be synchronously effected.

7 Claims, 6 Drawing Sheets

APPARATUS FOR INFEEDING CARTRIDGES TO AN ELEVATABLE FIRING WEAPON

BACKGROUND OF THE INVENTION

The present invention broadly relates to ammunition storage and conveyance and pertains, more specifically, to a new and improved apparatus for infeeding cartridges from a stationary ammunition magazine to an elevatable or elevationally adjustable firing weapon or gun.

Generally speaking, the cartridge infeeding apparatus of the present development is of the type comprising a cartridge infeed or guide channel in which ammunition is conveyed to the elevatable or elevationally adjustable firing weapon or gun, such firing weapon or gun being constructed for pivotal movement about an elevation axis and comprising a cartridge inlet or feed port.

When cartridges are delivered from a stationary cartridge magazine to an elevatable firing weapon or gun, it is customary to use a deflection or guidance unit which pivots or turns the cartridges according to the elevation of the firing weapon or gun and delivers the cartridges to the latter. A suitable deflection or guidance unit can be, for example, a disk channel as disclosed, for instance, in German Published Patent Application No. 3,204,499, published Aug. 18, 1983. The individual disks of such disk channel are rotatably mounted at a housing, whereby these disks are guided by rolls at the cylindrical inner wall of the housing These disks are provided with throughpass apertures, through which the cartridges are guided. In order that the ammunition belt is uniformly subject to torsional force, the disks are connected by a gearing mounted on a shaft. When this shaft is rotated by the rotatable or pivotable part of the weapon, the gearing for each disk is driven, whereby the transmission ratios are selected such that, starting at the rotatable or pivotable part of the weapon, the twisting angle decreases from disk to disk. A guide channel can be provided to ensure the passageway of cartridges through the throughpass apertures of the individual disks, such throughpass apertures being connected by flexible material.

Instead of the aforenoted disk channel, there can be used a flexible chute or guide as disclosed, for example, in U.S. Pat. No 3,437,005, granted Apr. 8, 1969. A flexible conveyor mechanism delivers ammunition rounds between a high rate-of-fire gun, for instance a "Gatling-gun", and an ammunition storage device movable relative thereto. The flexible conveyor mechanism includes an outer flexible chute or guide having walls forming a passageway generally rectangular in cross-section. A helical member extending through such passageway comprises a series of open wire volutes and is a relatively stiff spring-like continuous wire, the diameter of the wire being selected depending on the torque requirements.

Such flexible conveyor chute or guide transfers ammunition rounds under adverse conditions including twisting, fanning or bending of the conveyor as the result of the aforementioned relative movement These known ammunition conveyor or infeed systems all have considerable disadvantages:

(i) The elevational range is restricted by a disk channel. For example, the weapon can be upwardly and downwardly pivoted only from a central or intermediate position, so that problems arise when the weapon is pivoted into the horizontal position or the azimuthal position.

(ii) A disk channel requires a relatively great deal of space and possesses a relatively large mass which has to be accelerated and decelerated during operation as the gun swivels and pivots.

(iii) Flexible conveyor chutes or guides are subject to considerable wear and stress when the belt of ammunition is twisted and bent due to the relative movement between the firing weapon and the storage container. Furthermore, such flexible conveyor chutes are often of a considerable length and, therefore, can disturb or interfere with the movement of the firing weapon.

SUMMARY OF THE INVENTION

Therefore, with the foregoing in mind, it is a primary object of the present invention to provide a new and improved construction of apparatus for infeeding cartridges from a stationary ammunition magazine to an elevatable or elevationally adjustable firing weapon and which apparatus is not afflicted with the drawbacks and limitations of the prior art.

Another and more specific object of the present invention aims at providing an improved cartridge infeeding apparatus which requires a minimum of space, does not necessitate additional driving power, and affords a high degree of reliability for use in delivering ammunition at very high delivery speeds in random elevational positions of the elevatable firing weapon.

Now in order to implement these and still further objects of the present invention which will become more readily apparent as the description proceeds, the apparatus for feeding cartridges to an elevatable firing weapon or gun and constructed according to the invention is manifested, among other things, by the features that the cartridge infeed or guide channel is structured to form a circular arc having a predetermined center of curvature located in the elevation axis of the elevatable firing weapon or gun. The tips of the cartridges located in the cartridge infeed or guide channel are oriented toward the elevation axis and the lengthwise axes of the cartridges located in the cartridge infeed or guide channel are radially arranged with respect to the elevation axis of the elevatable firing weapon. The aforenoted pivotal movement of the elevatable firing weapon about the elevation axis defines a pivot plane and the cartridge infeed or guide channel is arranged substantially parallel to the pivot plane of the elevatable firing weapon. In the cartridge infeed or guide channel there is arranged at least one endless conveyor chain, by means of which the cartridges are conveyed to the cartridge inlet or feed port of the elevatable firing weapon. Means are provided for extending and contracting the endless conveyor chain during the pivotal movement of the elevatable firing weapon or gun about the elevation axis, whereby the endless conveyor chain is extended and contracted in accordance with each and every or the momentary position of the elevatable firing weapon or gun within the pivot plane.

The endless conveyor chain arranged in the cartridge infeed or guide channel structured to form a circular arc advantageously comprises a plurality of buckets or cradles and the aforenoted means for extending and contracting the endless conveyor chain constitute, for instance, knee or toggle joints provided between respective pairs of adjacent buckets or cradles of the plurality of buckets or cradles. Each knee or toggle joint located between each two adjacent buckets or cradles comprises at least two lugs pivotably connected to one another, whereby one lug is pivotably mounted at one of the two adjacent buckets or cradles and the other lug is pivotably mounted at the other one of the two adjacent buckets or cradles.

The cartridge infeed or guide channel structured to form a circular arc is advantageously constructed as a telescopic channel, whereby means are provided for telescopingly extending and contracting the telescopic channel during the aforementioned pivotal movement of the elevatable firing weapon about the elevation axis thereof.

The means for telescopingly extending and contracting the telescopic channel preferably comprises a plurality of guide rails or tracks suitably structured to be telescopingly shifted into one another and telescopingly drawn out from one another.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of apparatus for infeeding cartridges to an elevatable firing weapon has been illustrated therein as is needed to enable one skilled in the art to readily understand the underlying principles and concepts of this invention.

Figure 1:
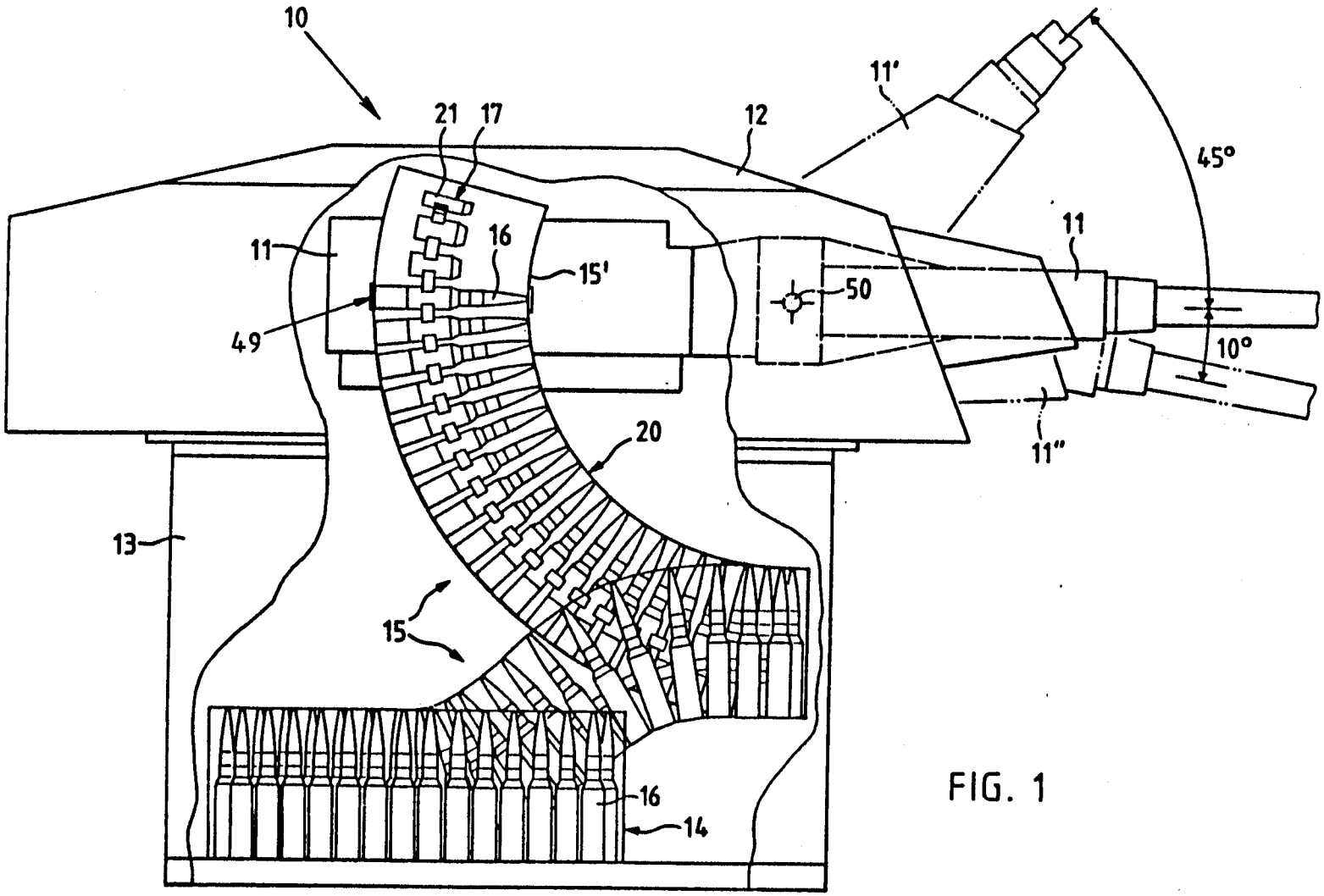
FIG. 1 schematically shows a side view, partially in section, of an armored turret comprising a firing weapon and an ammunition magazine as well as an exemplary embodiment of the cartridge infeeding apparatus constructed according to the invention.

Turning attention now specifically to FIG. 1 of the drawings, a schematically illustrated armored turret 10 shown therein by way of example and not limitation will be seen to comprise a firing weapon or gun 11 which is partially protected by an armored hood 12. Below this armored hood 12 there is located a container 13 accommodating at the bottom thereof a cartridge magazine 14.

Figure 3:
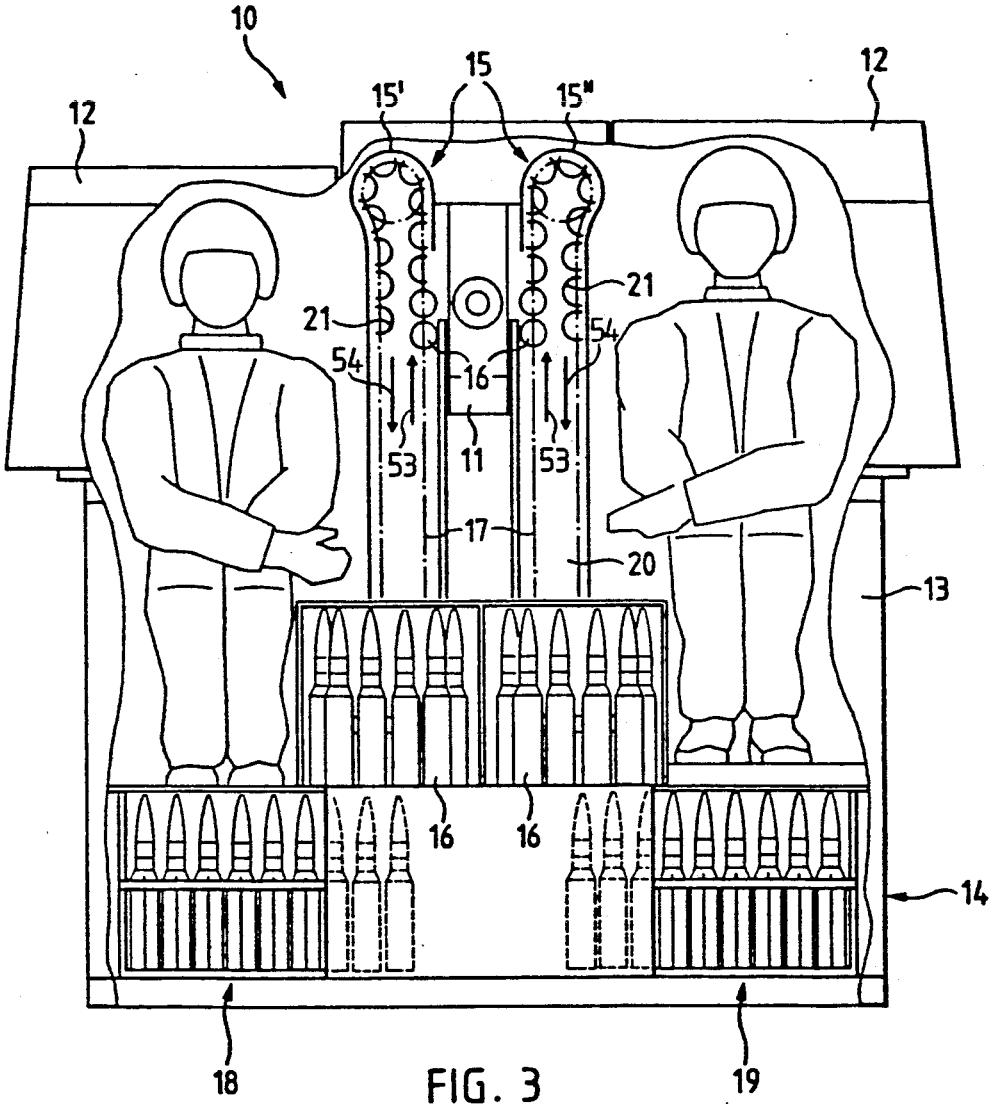
FIG. 3 schematically shows a front view, partially in section, of the armored turret depicted in FIG. 1.

According to FIG. 3, an attendance or operating crew for the firing weapon or gun 11 is accommodated partly in the armored hood 12 and partly in the container 13. In known manner, the armored turret 10 is rotatably mounted in a suitable tank or armored vehicle not particularly illustrated in the drawings. Cartridges 16 located in the cartridge magazine 14 as well as in a cartridge infeeding apparatus 15 are arranged in bucket or cradle chains 17, as is also apparent from FIGS. 4 and 5. By means of these bucket or cradle chains 17, the cartridges 16 are conveyed, on the one hand, out of the cartridge magazine 14 and, on the other hand, from this cartridge magazine 14 to the firing weapon or gun 11.

The firing weapon or gun 11 is pivotable or rotatable about an elevation axis 50. Three different elevational positions of the firing weapon or gun 11 are indicated in FIG. 1. In a first elevational position, the firing weapon or gun 11 is arranged to be substantially horizontal. In a second elevational position conveniently designated by reference numeral 11' and indicated by dash-and-dot lines, the firing weapon or gun 11 is shown to be inclined at an angle of approximately +45°. In a third elevational position conveniently designated by reference numeral 11'' and indicated by dash-and-dot lines, the angle of elevation of the firing weapon or gun 11 is shown to be approximately −10°. The delivery of ammunition to the firing weapon or gun 11 must be ensured in each of these three elevational positions and, furthermore, in all intermediate positions.

As mentioned hereinbefore, a specific object of the present invention aims at providing an apparatus for infeeding cartridges to an elevatable firing weapon, such as the aforenoted cartridge infeeding apparatus 15, which apparatus affords highly reliable infeed of cartridges 16 at any inclination, i.e. any elevation of the firing weapon or gun 11 as is described hereinafter.

Figure 2:
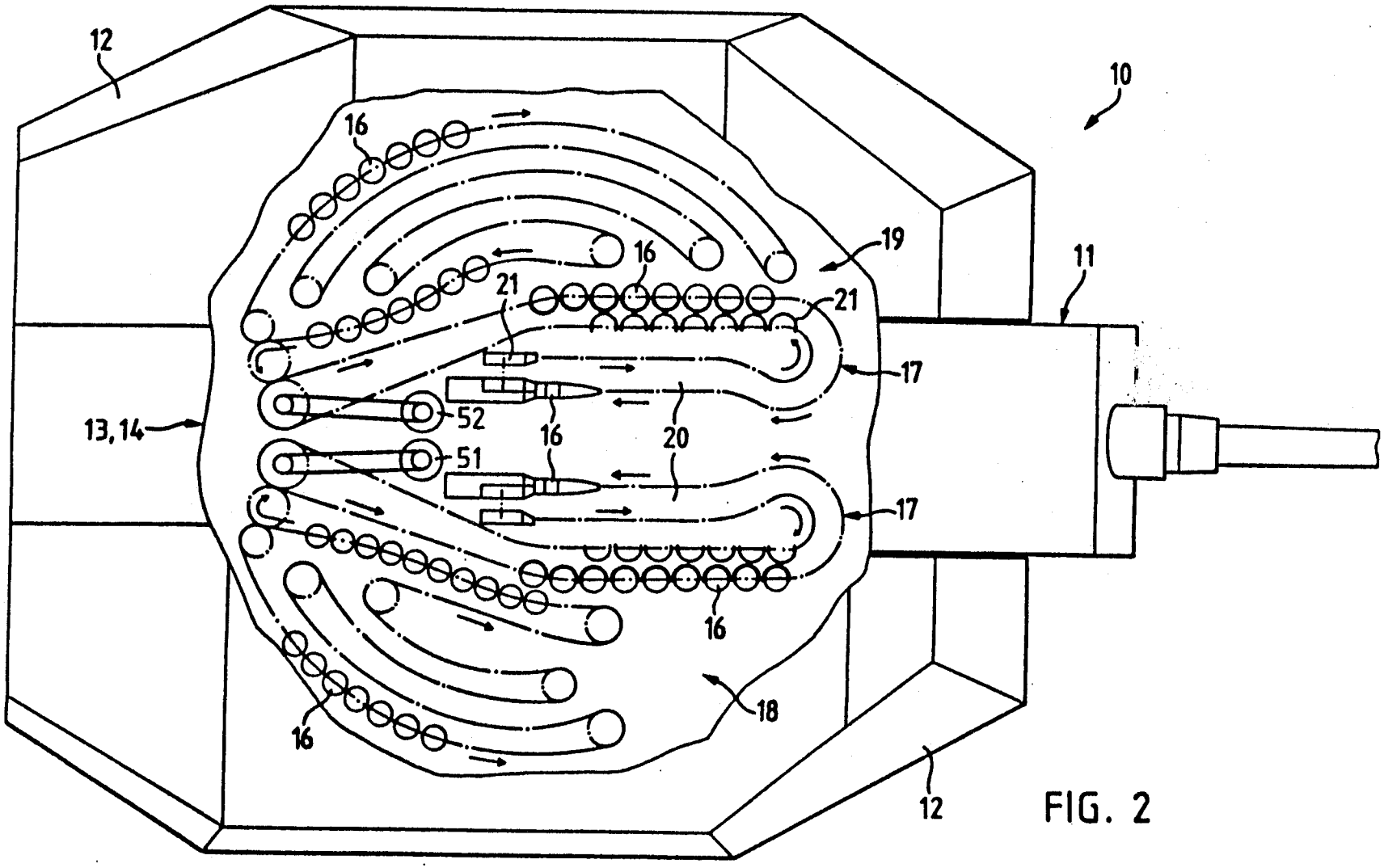
FIG. 2 schematically shows a top plan view, partially in section, of the armored turret depicted in FIG. 1.

According to FIGS. 2 and 3, the cartridge magazine 14 is subdivided into two halves, namely a right half 18 and a left half 19, when viewed in the firing direction of the firing weapon or gun 11. As is apparent from FIG. 3, the cartridge infeeding apparatus 15 constitutes a first cartridge infeeding apparatus 15' and a second cartridge infeeding apparatus 15''. The first cartridge infeeding apparatus 15' conveys from the right, when viewed in the firing direction of the firing weapon or gun 11, the cartridges 16 from the right half 18 of the cartridge magazine 14 to the firing weapon or gun 11. The second cartridge infeeding apparatus 15'' conveys from the left, when viewed in the direction of the firing weapon or gun 11, the cartridges 16 from the left half 19 of the cartridge magazine 14 to the firing weapon or gun 11. This renders possible selectively delivering two different types of ammunition to the firing weapon or gun 11. As is apparent from FIG. 1, the two cartridge infeeding apparatuses 15' and 15'' comprise an arc-shaped or arcuate or curved guide or infeed channel 20. The center of curvature of this arc-shaped or arcuate guide channel 20 coincides with the elevation axis 50 such that, in any position of the firing weapon 11, the cartridges 16 can be delivered in the arc-shaped or arcuate guide channel 20 to a cartridge inlet or feed port of the firing weapon 11, which cartridge inlet or feed port is generally designated hereinafter by reference numeral 49 in FIG. 1. As described hereinbelow, this arc-shaped or arcuate guide channel 20 can be telescopically lengthened and shortened such that, in whatever elevational position of the firing weapon or gun 11, the end of the arc-shaped or arcuate guide channel 20 is located in the zone or region of the aforenoted cartridge inlet or feed port 49.

In order that the bucket or cradle chains 17 located in the arc-shaped or arcuate guide channel 20 can be lengthened and shortened when the arc-shaped or arcuate guide channel 20 is telescopingly lengthened and shortened, these two bucket or cradle chains 17 are correspondingly constructed and designed as will be described hereinbelow in conjunction with FIGS. 4 and 5.

Each bucket or cradle chain 17 comprises a plurality of buckets or cradles 21 which are of conventional type or construction and, therefore, need not here be further considered. Each bucket or cradle 21 serves to receive or accommodate a cartridge 16, as particularly apparent from FIG. 5. The buckets or cradles 21 are connected to each other by means of three lugs or joint bars 22, 23 and 24 in the form of a knee or toggle joint. In FIG. 4, only the two lugs or joint bars 22 and 23 are visible because, in the side view of the bucket or cradle chain 17 shown in FIG. 4, the lug or joint bar 24 is located directly behind the lug or joint bar 23.

Figure 4:
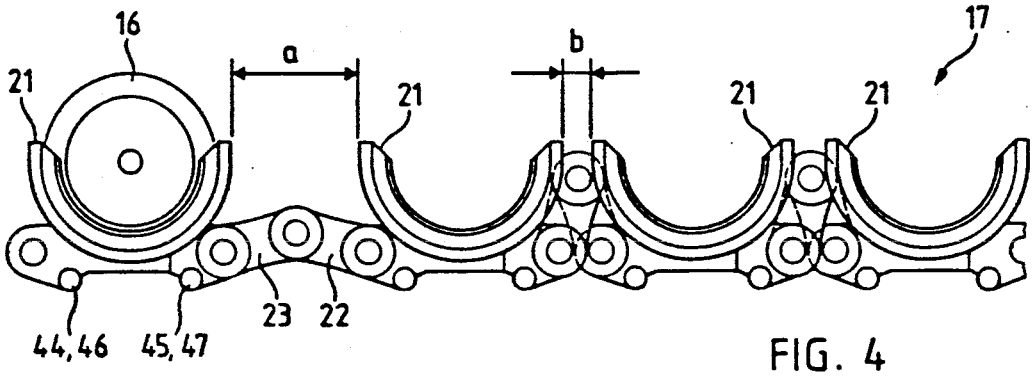
FIG. 4 shows side view of a portion of a bucket chain for delivering cartridges from the ammunition magazine to the firing weapon of the armored turret depicted in FIG. 1.
Figure 5:
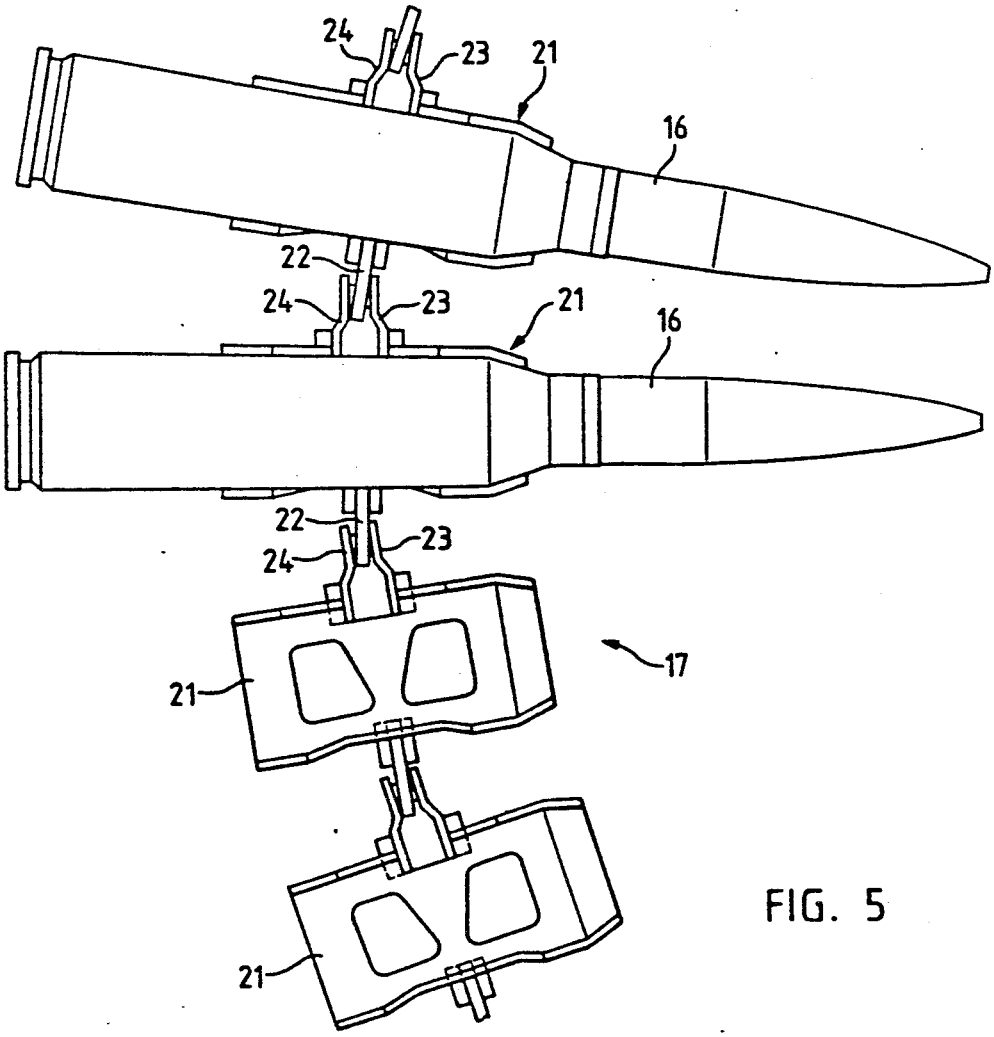
FIG. 5 shows a plan view of the portion of the bucket chain illustrated in FIG. 4.

As is apparent from FIG. 5, the two lugs or joint bars 23 and 24 are pivotably mounted at a bucket or cradle 21, while the lug or joint bar 22 is pivotably mounted at the adjacent or next following bucket or cradle 21 and forms with the other two lugs or joint bars 23 and 24 a knee or toggle joint. By means of these three lugs or joint bars 22, 23 and 24 provided between each two adjacent or neighboring buckets or cradles 21, it is possible to enlarge or reduce the spacing between adjacent or neighboring buckets or cradles 21. According to FIG. 4, the maximum spacing a can be reduced to the minimum spacing b. The lugs or joint bars 22, 23 and 24 are structured such that the bucket or cradle chains 17 can be curved or bent in different planes. In particular, the bucket or cradle chains 17 can be adapted to the arcuate curvature of the arc-shaped or arcuate guide channel 20, as is apparent from FIG. 5.

Figure 6:
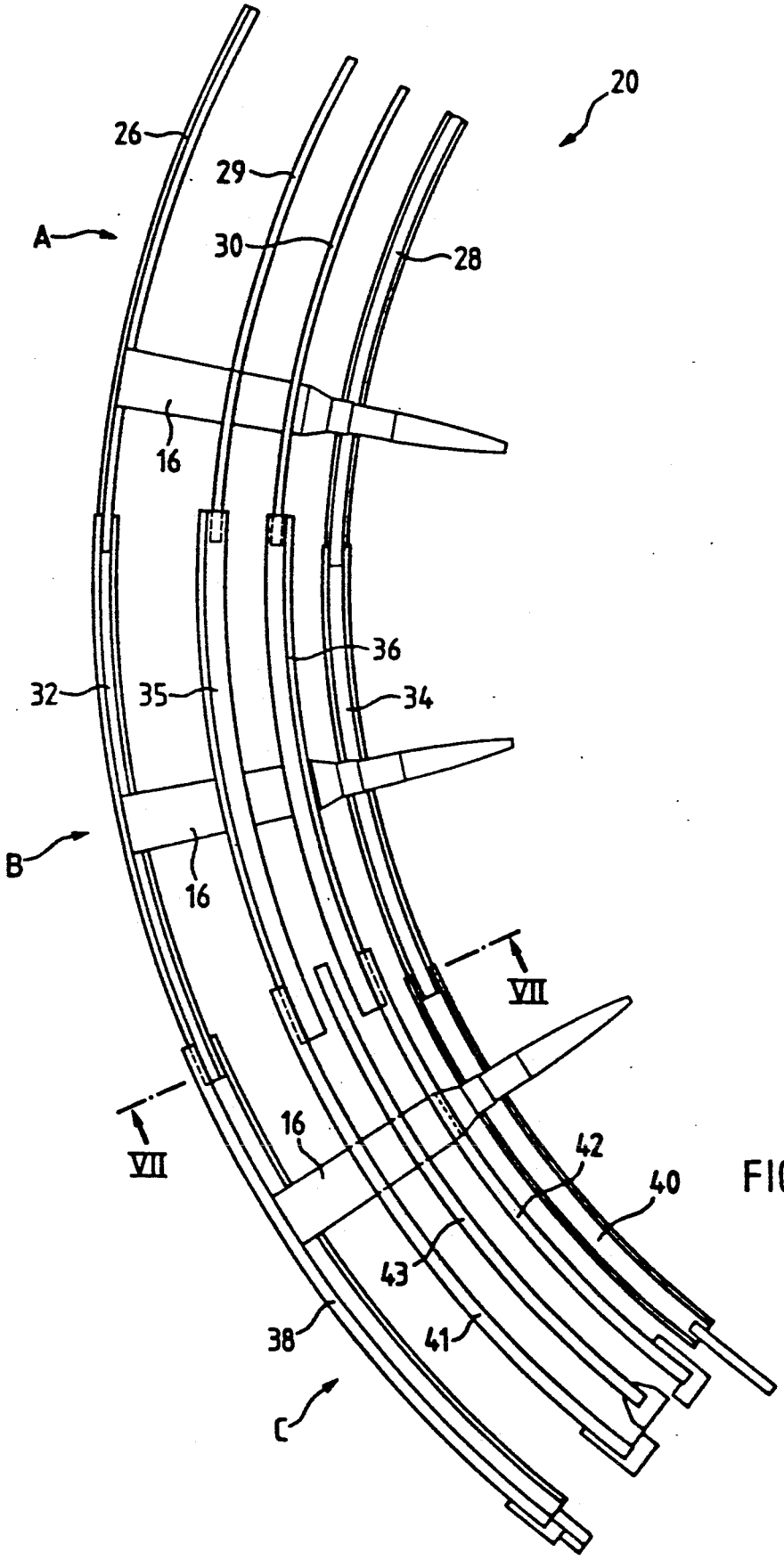
FIG. 6 shows a side view of a telescopic guide device for the bucket chain, a portion of which is depicted in FIG. 4.

The construction of the arc-shaped or arcuate guide channel 20 will be considered hereinafter in greater detail in conjunction with FIGS. 6 and 7. According to FIG. 6, the arc-shaped guide or infeed channel 20 comprises three groups of rails A, B and C, such groups of rails A, B and C telescoping with one another.

The first group of rails A comprises four outer guide rails or tracks 25 through 28 and two inner guide rails or tracks 29 and 30.

The second group of rails B likewise comprises four outer guide rails or tracks 31 through 34 and two inner guide rails or tracks 35 and 36.

The third group of rails C likewise comprises four outer guide rails or tracks 37 through 40 and two inner guide rails or tracks 41 and 42.

Figure 7:
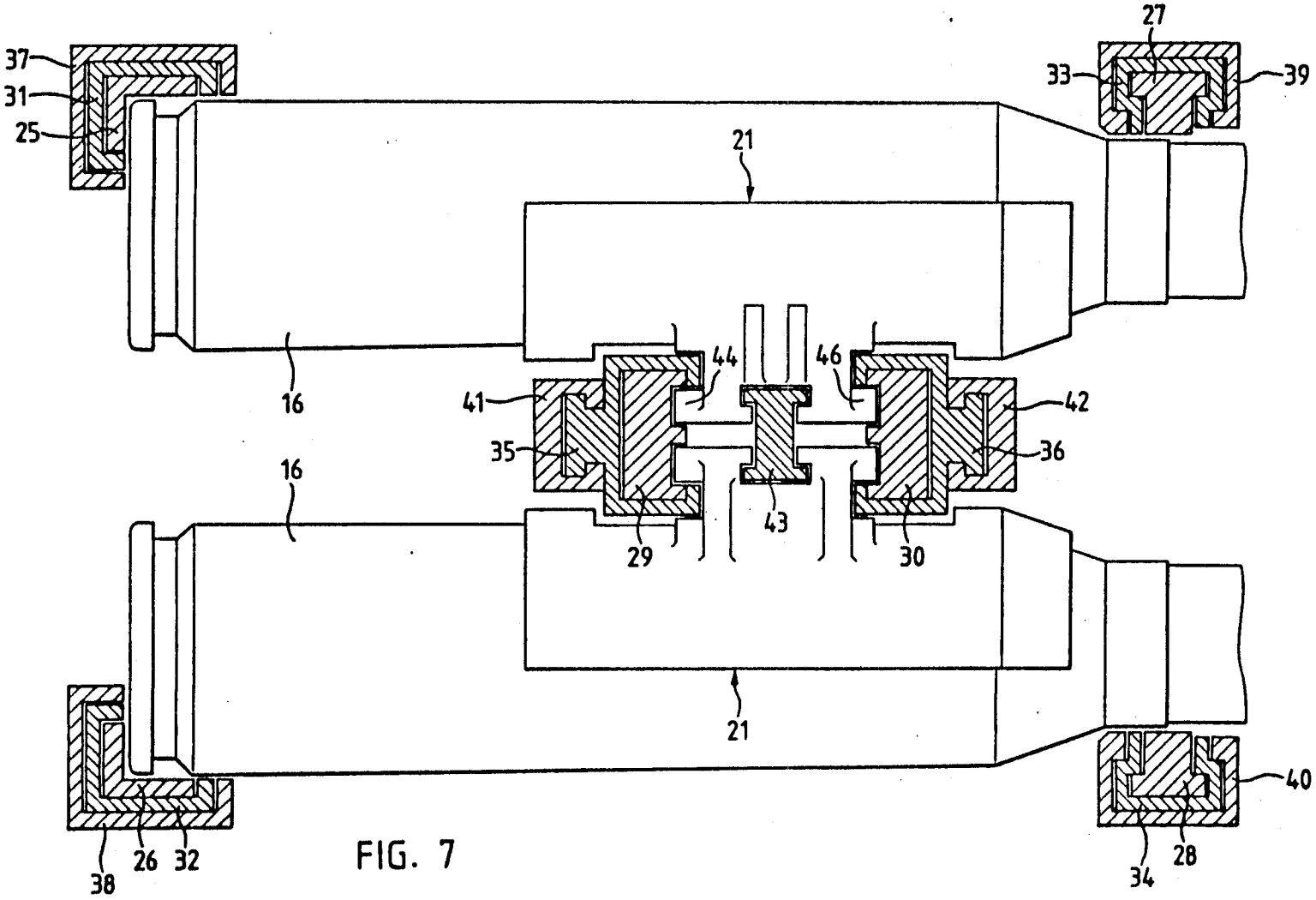
FIG. 7 shows, on an enlarged scale, a cross-section through the telescopic guide device depicted in FIG. 6 and taken substantially along the line VII—VII in FIG. 6.

In FIG. 7, all 18 rails or tracks 25 through 42 are shown in a sectional view. The twelve outer rails or tracks 25 through 28, 31 through 34, and 37 through 40 serve to guide the cartridges 16, while the six inner rails or tracks 29 and 30, 35 and 36, and 41 and 42 serve for guiding the two bucket or cradle chains 17, of which only two buckets or cradles 21 are illustrated in FIG. 7.

The outer guide rails or tracks of each of the three groups of rails A, B and C, namely the outer guide rails or tracks 25 through 28, 31 through 34, and 37 through 40, are capable of guiding the cartridges 16.

Likewise, the inner guide rails of each of the two groups of rails A and B, namely the inner guide rails or tracks 29, 30 and 35, 36, are capable of guiding the buckets or cradles 21.

However, as is apparent from FIG. 7, the two inner guide rails or tracks 41 and 42 of the third group of rails C are not capable of guiding the buckets or cradles 21. For this reason, there is provided a further inner guide rail or track 43 which can guide the buckets or cradles 21 when the arc-shaped or arcuate guide channel 20 is fully extended or stretched, as depicted in FIG. 6.

According to FIGS. 4 and 7, each bucket or cradle 21 comprises four guide bolts or pins 44 through 47, whereby only the two guide bolts or pins 44 and 45 are visible in the side view of the bucket or cradle chain 17 shown in FIG. 4 and, accordingly, only the two guide bolts or pins 44 and 46 are visible in the sectional view of the arc-shaped or arcuate guide channel 20 shown in FIG. 7. The outer ends of the four guide bolts or pins 44 through 47 are guided by the four inner guide rails or tracks 29, 30 and 35, 36, while the inner ends of the four guide bolts or pins 44 through 47 are guided by the further inner guide rail or track 43, as is apparent from FIG. 7.

According to FIG. 7, there are provided in back-to-back or adjacent formation two conveying-active runs of one of the two bucket or cradle chains 17, whereby one conveying-active run delivers the cartridges 16 to the firing weapon or gun 11, while the other conveying-active run returns the cartridges 16 to the cartridge magazine 14. As is particularly apparent from FIG. 3, these two conveying-active runs of the bucket or cradle chain 17 come together at the upper end to form a loop. The upper end of the arc-shaped or arcuate cartridge guide or infeed channel 20 is connected to the firing weapon or gun 11, and the lower end of the arc-shaped or arcuate cartridge guide channel 20 is connected to the stationary cartridge magazine 14 such that, when the firing weapon or gun 11 pivots about the elevation axis 50, the arc-shaped or arcuate cartridge guide or infeed channel 20 is automatically contracted or extended, depending upon whether the angle of elevation is increased or reduced.

Having now had the benefit of the detailed description of the construction of the inventive apparatus for infeeding cartridges from a stationary cartridge magazine to an elevatable firing weapon or gun, the mode of operation of the cartridge infeeding apparatus 15 will now be considered in conjunction with the drawings and is as follows:

When the firing weapon or gun 11 is operated by placement into its rapid firing mode, the respective bucket or cradle chain 17 at the upper end of the arc-shaped or arcuate guide channel is directly driven by the firing weapon or gun 11, such drive being synchronous to the rate of fire or cadence of the firing weapon 11. At the lower end of the arc-shaped or arcuate guide channel 20 of the cartridge infeeding apparatus 15, the drive of the two bucket or cradle chains 17 is effected by respective suitable booster motors 51 and 52. By virtue of the bucket or cradle chains 17 being variable in length, these two booster motors 51 and 52 are not required to run exactly synchronous with the cadence of the firing weapon or gun 11.

The two booster motors 51 and 52 not only drive the two bucket or cradle chains 17 arranged at respective sides of the firing weapon or gun 11, but also all cartridges 16 provided in both halves 18 and 19 of the cartridge magazine 14 of the container 13. The cartridges 16 are thereby conveyed out of the cartridge magazine 14 and into respective bucket or cradle chains 17 which then deliver the cartridges 16 to the firing weapon or gun 11, as is particularly apparent from FIG. 2.

In the event of a firing burst or operation the arc-shaped or arcuate guide channel 20 is contracted or extended according to the elevation of the firing weapon or gun 11. If the firing gun or weapon 11 is downwardly inclined at an angle of approximately −10°, the arc-shaped or arcuate guide channel 20 must be completely drawn out or stretched as shown in FIG. 1. However, if the firing weapon or gun 11 is upwardly directed at an angle of elevation of approximately +45°, then the arc-shaped or arcuate guide channel 20 has to be entirely telescoped or contracted, since the cartridge inlet or feed port 49 of the firing weapon or gun 11 is then in its lowest elevational position. The maximum spacing a between individual neighboring buckets or cradles 21 of the respective bucket or cradle chain 17 is then reduced to the minimum spacing b, as is apparent from FIG. 4.

When the elevatable firing weapon or gun 11 reaches the maximum angle of elevation, namely +45°, the guide rails or tracks 25 through 40 of the three groups of rails A, B and C are completely telescoped in one another. On the other hand, when the firing weapon or gun 11 is lowered into its lowest elevational position, the guide rails or tracks 25 through 40 of the three groups of rails A, B and C are completely extended or stretched, as depicted in FIG. 6.

According to FIG. 3, the bucket or cradle chains 17 ascend on the inner side of the arc-shaped or arcuate guide or infeed channel 20, as indicated by arrows 53. Accordingly, at the outer side of the arc-shaped or arcuate guide channel 20 the bucket or cradle chains 17 descend as indicated by arrows 54. Cartridges 16 can be supplied or fed to the cartridge magazine 14 by means of this descending portion of the respective bucket or cradle chain 17.

While there are shown and described present preferred embodiments of the invention, it is to be distinctly understood that the invention is not limited thereto, but may be otherwise variously embodied and practiced within the scope of the following claims. Accordingly,

What we claim is:

1. An apparatus for infeeding cartridges from a stationary ammunition container to an elevatable firing weapon constructed for pivotal movement about an elevation axis and provided with a cartridge inlet port, comprising:

a cartridge infeed channel in which ammunition is transported to the elevatable firing weapon from the h stationary ammunition container;

said cartridge infed channel being constructed to form a circular arc having a predetermined center of curvature;

said predetermined center of curvature being located on said elevation axis;

the cartridges located in said cartridge infeed channel having respective cartridge tips and respective cartridge axes;

said cartridge tips of said cartridges located in said cartridge infeed channel being oriented toward said elevation axis;

said axes of said cartridges located in said cartridge infeed channel being radially arranged with respect to said elevation axis;

said pivotal movement of the elevatable firing weapon about said elevation axis defining a pivot plane;

said cartridge infeed channel being arranged substantially parallel to said pivot plane defined by said pivotal movement o the elevatable firing weapon;

at least one conveyor chain arranged in said cartridge infeed channel;

said conveyor chain conveying the cartridges to said cartridge inlet port of the elevatable firing weapon;

means or extending and contracting said conveyor changing during said pivotal movement of the elevatable firing weapon about said elevation axis; and said conveyor chain being extended and contracted in accordance with the monetary position of the elevatable firing weapon within pivot plane.

2. The apparatus as defined in claim 1, wherein:

said conveyor chain comprises a plurality of buckets;

said means or extending and contracting said conveyor chain constituting knee joints provided between each two adjacent buckets of said plurality of buckets of said conveyor chain;

each knee joint located between each two adjacent buckets comprising at least two lugs pivotably connected to one another; and said at least two lugs pivotably connected to each other constituting at least one lug pivotably mounted at one bucket of each two adjacent buckets and at least one lug pivotably mounted at the other bucket of each two adjacent buckets.

3. The apparatus as defined in claim 1, wherein:

said carbide channel structured to form a circular arc constitutes a telescopic channel; and said telescopic channel having means for extending and telescoping said telescopic channel during said pivotal movement of the elevatable firing weapon about said elevation axis.

4. The apparatus as defined in claim 3, wherein:

said means for extending and telescoping said telescopic channel constitute guide rails; and said guide rails being structured to be telescopingly shifted into one another and telescopingly drawn out from one another.

5. An apparatus for infeeding cartridges form a stationary ammunition container to an elevatable firing weapon constructed for pivotal movement about an elevation axial and provided with a cartridge inlet port, comprising:

a cartridge infeed channel in which ammunition is transported to the elevatable firing weapon;

said cartridge infeed channel being structured to form a circular arc having a predetermined center of curvature;

aid predetermined center of curvature being located on said elevation axis;

the cartridges located in said cartridge infeed channel having respective cartridge tips and respective cartridge axes;

said cartridge tips of said cartridges located in said cartridge infeed channel being orientated toward said elevation axis;

said cartridge axes of said cartridges locate din said cartridge infeed channel being radially arranged with respect to said elevation axis;

said pivotal movement o the elevatable firing weapon about said elevation axis defining a pivot plane;

said cartridge infeed channel being arranged substantially parallel toe said pivots plane define by said pivotal movement of the elevatable firing weapon;

at least one conveyor chain arranged in said cartridge infeed channel;

said conveyor chain conveying the cartridges to said cartridge inlet pot of the elevatable firing weapon;

means for extending and contracting said conveyor chain during said pivotal movement of the elevatable firing weapons bout said elevation axis; and said coneyor chain being extended and contacted in accordance with the momentary position of the elevatable firing weapon within said pivot plane;

said conveyor chain comprising a plurality of buckets;

said means for extending and contracting said conveyor chain constituting knee joints provided between each two adjacent buckets of said plurality of buckets of said conveyor chain;

each knee joint located between each two adjacent buckets comprising at least two lugs pivotably connected to one another; and said at least two lugs pivotably connected to each other constituting at least one lug pivotably mounted at one bucket of each two adjacent buckets and at least one lug pivotably mounted at the other bucket of each two adjacent buckets.

6. An apparatus for infeeding cartridges from a stationary ammunition container to an elevatable firing weapon constructed for pivotal movement about an elevation axis and provided with a cartridge inlet port, comprising:

a cartridge infeed channel in which ammunition is transported to the elevatable firing weapon;

said cartridge infeed channel being structured to form a circular arc having a predetermined center of curvature;

said predetermined center of curvature being located on said elevation axis;

said cartridge channels structured to form a circular arc constitutes a telescopic channel;

said telescopic channel having means for extending and telescoping said telescopic channel during said pivotal movement of the elevatable firing weapon about said elevation axis;

the cartridges located in said cartridge infeed channel having respective cartridge tips and respective cartridge axes;

said cartridge tips of said cartridges located in said cartridge infeed channel being oriented toward said elevation axis;

said cartridge axes of said cartridges located in said cartridge infeed channel being radially arranged with respect to said elevation axis;

said pivotal movement of the elevatable firing weapon about said elevation axis defining a pivot plane;

said cartridge infeed channel being arranged substantially parallel to said pivot plane defined by said pivotal movement oh e elevatable firing weapon;

at least one conveyor chain arranged in said cartridge infeed channel;

said conveyor chain conveying the cartridges to said cartridge inlet port of the elevatable firing weapon;

means for extending and contracting said coneyor chain during said pivotal movement of he elevatable firing weapon about said elevation axis; and said conveyor chain being extended and contracted in accordance with he momentary position of the elevatable firing weapon within said pivot plane.

7. The apparatus as defined in claim 6, wherein :

said means for extending and telescoping said telescopic channel constitute guide rails; and said guide rails being structured to be telescopingly shifted into one another and telescopingly drawn out from one another.

* * * * *